United States Patent [19]

Kerfoot et al.

[11] 3,955,169

[45] May 4, 1976

[54] HIGH POWER RESISTOR

[75] Inventors: Charles S. Kerfoot, Pasadena; Frank A. Halgas, Laurel; Louis A. Razzetti, Severna Park; Gene A. Di Gennaro, Dundalk, all of Md.

[73] Assignee: The United States of America as represented by the Secretary of the Air Force, Washington, D.C.

[22] Filed: Nov. 8, 1974

[21] Appl. No.: 522,369

[52] U.S. Cl. ..... 338/51; 338/297; 174/16 HS

[51] Int. Cl.[2] ..... H01C 1/084

[58] Field of Search ..... 338/51, 300, 292, 297; 174/DIG. 5

[56] References Cited

UNITED STATES PATENTS

| | | | |
|---|---|---|---|
| 481,781 | 8/1892 | Carpenter | 338/51 |
| 1,767,715 | 6/1930 | Stoekle | 338/300 |
| 3,058,041 | 10/1962 | Happ | 174/DIG. 5 |
| 3,246,213 | 4/1966 | Hannan | 174/DIG. 5 |
| 3,271,722 | 9/1966 | Garstang | 174/DIG. 5 |
| 3,573,567 | 4/1971 | Harris | 174/DIG. 5 |
| 3,694,786 | 9/1972 | Rosema | 174/DIG. 5 |
| 3,845,443 | 10/1974 | Fisher | 338/292 |

FOREIGN PATENTS OR APPLICATIONS

| | | | |
|---|---|---|---|
| 659,585 | 3/1963 | Canada | 174/DIG. 5 |

*Primary Examiner*—E. A. Goldberg
*Attorney, Agent, or Firm*—Joseph E. Rusz; Henry S. Miller

[57] ABSTRACT

A thick film spiral shaped resistor deposited on an alumina substrate and bonded to a Kovar plate, an aluminum heat sink is coated on one side with a silicon grease and the Kovar plate is bolted thereto.

3 Claims, 2 Drawing Figures

HIGH POWER RESISTOR

BACKGROUND OF THE INVENTION

This invention relates generally to electrical resistors and more specifically to miniaturized high power resistors. Currently there are no known resistors available that are simultaneously rated for high voltage, high power and high value, adaptable to be used in miniaturized electronic circuitry. Past practice has been to construct the desired resistor with a plurality of smaller components. Because of the large number of components that are required to be series-paralleled to achieve the desired voltage and power ratings, temperature stability and precise resistance value are difficult, if not impossible to attain.

Custom produced resistor assemblies can be fabricated on an individual basis however, they are expensive and limited to relatively low power in the order of 5KV and 10 watts. Even custom fabricated assemblies that surpass this voltage suffer a a power derating and beyond this power demonstrate a voltage derating.

As a result, there has long been a need for a high power resistor that is temperature stable, non-inductive and small in size and volume.

SUMMARY OF THE INVENTION

The invention involves a high power resistor that avoids the disadvantages of the prior art. The single component device will operate at voltages and power up to 18 KV and 185 watts, far in excess of known similar devices. The resistor employs a specially designed thick film resistor screened onto an alumina substrate. The substrate is bonded to an Alloy F-15 plate with a thermally conductive cement to insure good heat transfer characteristics. An aluminum heat sink, having sufficient area to dissipate the wattage within a given temperature rise limit is mechanically fixed to the Alloy F-15 plate. A lubricant is applied to the mating surfaces of the Alloy F-15 and aluminum to allow for expansion and construction variations between the two materials.

The particularly novel aspect of the invention consists of the form and construction of the resistive element which meets all of the aforementioned requirements. The resistor is long to prevent voltage drift. However, to avoid excessive length, the thick film is deposited in a spiral configuration. Since the invention is adopted for use with microcircuits, frequently vertical space limitations are imposed, hence the resistor material is deposited on an alumina substrate to insure voltage and uniform heating within a vertical space limitation.

With the spiral resistor configuration, the voltage potential is applied to the centrally located thick film termination pad of the spiral, thereby insuring minimum voltage stress with the grounded surrounding heat sink.

Under operational conditions, the substrate mounted thick film resistor generates large quantities of heat. The invention must therefore be assembled with the heat dissipating structure (heat sink) in such a way that the substrate will suffer neither a mechanical nor electrical failure under the maximum designed power requirements. Since alumina provides minimal flexure strength, it must normally be supported by a relatively solid mechanical support. Where heat dissipation is a critical consideration, it must be insured that the substrate is properly affixed to its supporting means for maximum heat transfer. It has been found that Alloy F-15 thereafter also known as Kovar, which closely matches the thermal properties of alumina, provides an adequate solid mechanical support. Further, the Alloy F-15 material functions as a plane of constant temperature to dissipate hot spots in the alumina substrate. By utilizing a highly thermally conductive epoxy cement it is possible to securely bond the substrate to the Alloy F-15 support.

In mounting the heat sink on the Alloy F-15 support, a cohesive bond cannot be achieved due to the variations in coefficient of expansion between the two materials; hence a high temperature silicon greas film is placed between the members to avoid undue wear over long periods.

It is therefore an object of the invention to provide a new and improved high power resistor.

It is another object of the invention to provide a new and improved high power resistor for microcircuits that is smaller in size and volume than any hitherto known similar devices.

It is a further object of the invention to provide a new and improved high power resistor for microcircuits that is temperature stable.

It is still another object of the invention to provide a new and improved high power resistor for microcircuits that is non inductive.

It is still a further object of the invention to provide a new and improved high power resistor for microcircuits that provides a precision resistance value.

It is another object of the invention to provide a new and improved high power resistor for microcircuits that may be produced at a lower cost than those currently available.

It is another object of the invention to provide a new and improved high power resister that is simultaneously rated for high voltage, high power and high value.

These and other advantages, features, and objects of the invention will become more apparent from the following description taken in connection with the illustrative embodiment in the accompanying drawing.

DESCRIPTION OF THE PREFERRED EMBODIMENT

Figure 1:
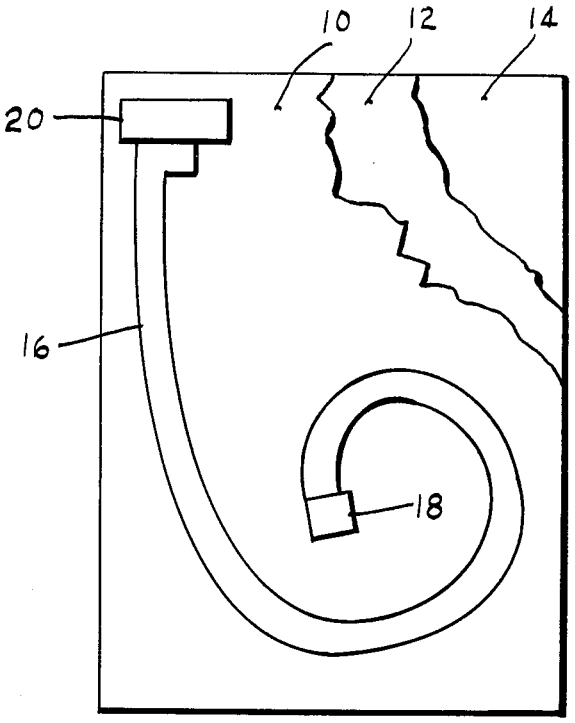
FIG. 1 is a top view of the invention.

Referring now in more detail to the aforesaid illustrative embodiment of the invention and with particular reference to the drawing illustrating the same, in FIG. 1, the numeral 10 illustrates an alumina substrate. The substrate is bonded to a Kovar base 14. The bonding material 12 has suitable adhesive characteristics and excellent heat transfer qualities such as a thermally conductive epoxy.

Resistor 16 is screened onto the substrate in a spiral configuration and is in a thick film form utilizing conventional materials. In operation, the voltage potential is applied to the center termination pad 18. Output of the resistor is via output termination pad 20.

Figure 2:
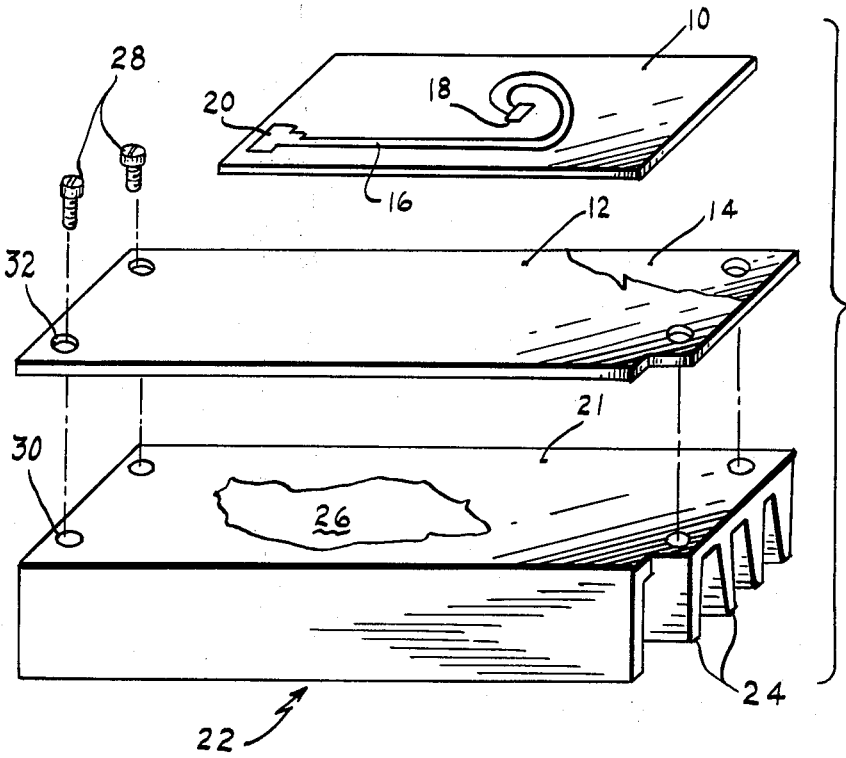
FIG. 2 is an exploded side view of the invention.

Concerning FIG. 2, the resistor is shown at 16 with terminal pads 18 and 20 on the substrate 10. Bonding material is illustrated at 12 on the heat plane 14 of Kovar or other suitable material. Generally, at 22 an aluminum heat sink is illustrated having a flat surface 21 congruant to the heat plane 14 on one side and longitudinally extending heat dispensing fins 24 on the opposite side. The heat sink is provided with sufficient surface area to dissipate the heat from the appropriate wattage within a given temperature rise limit. A coating of high temperature grease 26 is applied to the planular surface 21 to allow for smooth expansion and contraction between the abutting surfaces during operation.

In assembly the substrate 10 is bonded to the heat plane 14 as aforementioned. That subassembly is then mechanically affixed to the heat sink by machine screws 28. It has been found that tapping the heat sink in each corner 30 and placing the screws through the appropriate openings 32 in the heat plane is an expeditious method of performing this operation although other suitable methods may be used.

Electrical connections to the resistor are made through the terminal pads 18 and 20 and are very conventional as for example solder connectors which are well known.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A high power resistor for microcircuits comprising:

a planular alumina substrate; a longitudinally extending, thick film resistive means having a planar spiral configuration at one terminus, deposited on the substrate; terminal means affixed to opposite ends of the resistive means; a heat plane base means; means for bonding the base means to the substrate means; heat sink means adapted to conform in one surface dimension to one surface dimension of the base means; means for affixing the conforming surface dimensions of the heat sink means to the base means, and means for lubricating the abutting surfaces.

2. A high power resistor for micro-circuits according to claim 1 wherein the bonding means is a thermally conductive epoxy cement.

3. A high power resistor for microcircuits according to claim 1 wherein, the lubricating means is a high temperature silicon grease.

* * * * *